United States Patent [19]

Laughlin et al.

[11] Patent Number: 4,604,510

[45] Date of Patent: Aug. 5, 1986

[54] METHOD AND APPARATUS FOR HEAT TREATING CAMSHAFTS

[75] Inventors: John R. Laughlin, Broadview Heights; George M. Mucha, Parma Heights, both of Ohio

[73] Assignee: Tocco, Inc., Boaz, Ala.

[21] Appl. No.: 736,214

[22] Filed: May 20, 1985

[51] Int. Cl.[4] ..... H05B 6/40

[52] U.S. Cl. ..... 219/10.43; 219/10.57; 219/10.49 R; 219/10.67; 148/147; 148/150; 266/127; 266/129

[58] Field of Search ..... 219/10.57, 10.43, 10.41, 219/10.49 R, 10.67, 10.69, 10.71, 10.79; 148/150, 146, 147, 152, 154; 266/129, 130, 124, 134, 127, 114

[56] References Cited

U.S. PATENT DOCUMENTS

| | | | |
|---|---|---|---|
| 2,295,777 | 9/1942 | Denneen et al. | 266/127 X |
| 3,622,138 | 11/1971 | Kostyal | 266/129 X |
| 3,784,780 | 1/1974 | Laughlin et al. | 219/10.43 |
| 3,944,446 | 3/1976 | Bober | 148/150 X |
| 3,967,089 | 6/1976 | Seulen et al. | 219/10.67 |
| 3,986,710 | 10/1976 | Day et al. | 266/129 |
| 4,438,310 | 3/1984 | Cachat | 219/10.57 X |

*Primary Examiner*—Philip H. Leung

*Attorney, Agent, or Firm*—Body, Vickers & Daniels

[57] ABSTRACT

A method and apparatus for heat treating camshafts includes a retractable shield positioned between a previously hardened surface and a surface being heat treated. During the induction heating and quenching cycle, a coolant is delivered to the hardened surface to maintain the temperature thereof below the tempering temperature. The shield prevents the coolant from contacting the unhardened surface and interfering with the heating and quenching thereof.

26 Claims, 10 Drawing Figures

METHOD AND APPARATUS FOR HEAT TREATING CAMSHAFTS

BACKGROUND

The present invention relates to the art of induction heating and, in particular, to a method and apparatus for the heat treating of camshafts for internal combustion engines.

The invention will be described with reference to engine camshafts. however it will be appreciated that the invention has broader aspects and may, for instance, be used for various elongated workpieces having spaced hardened surfaces which must be individually heated without affecting the hardened integrity of an adjacent previously hardened surface.

Induction hardening is a proven process for hardening the cam lobes for the camshafts of internal combustion engines. In one system, individual camshaft lobes are induction heated, one at a time, with relatively low power densities to the elevated hardening temperature. After heating, the camshafts are immersed into a quenching bath. This sequential method is time consuming and costly. Other methods have been developed for heating multiple cam lobes at a time ultimately leading to the simultaneous heating of all the cam lobes followed by immersion of the entire camshaft in the quenching bath. Because of the number of inductor coils used for simultaneous heating, power supply limitations restrict this approach to low power density systems, which provide a substantial hardening depth but not a consistently uniformly hardened surface.

Recently, roller lifters have been adopted to provide greater service life and accuracy in the actuation of the engine valve train. These rollers impose substantially higher compressive loads on the cam lobe. Accordingly, the uniformity of hardening is of utmost importance to resist lobe deformation and wear. This has lead to the development of high power density, short time induction heating of the cam lobes. Because of the higher power requirements, such methods are restricted to heating one cam lobe at a time. Generally, this has involved placing the camshaft in a vertical orientation and each cam lobe is heated and quenched sequentially until all the cam lobes are hardened.

The high power density induction heating of camshafts presents certain problems in attaining an overall uniformity of hardness. Inasmuch as the cam lobes are closely spaced, the peripheral edges of adjacent camshaft lobes experience stray induction heating. Previously hardened cam lobes are thus prone to tempering, leading to an undesirable decrease in hardness and uniformity. While flux shields have been used in other applications for limiting the effects of stray induction heating, their use in conjunction with the extremely closely spaced cam lobes adversely affects the flux field of the cam lobe being heated. Accordingly, there is a need for high power density induction heating systems for camshafts that will insure the efficient production of uniformly hardened cam lobes.

BRIEF SUMMARY OF THE INVENTION

The present invention provides a method and apparatus overcoming the above limitations and disadvantages by maintaining the temperature of the hardened cam lobe below its tempering temperature without affecting the optimum heat treating environment of the lobe being heat treated. This is accomplished by quenching the hardened cam lobe during the heat treating cycle of a succeeding cam to overcome a temperature rise through stray induction heating or thermal conductance. In so doing, however, the quenching media must not impinge the surface being heated. Otherwise, owing to the short heating cycle, the cam lobe surface will not attain the required elevated temperature and uniformity. However, controlling the direction and velocity of such coolant to avoid contact or with the adjacent area is difficult, if not impossible to attain. This is achieved in the present invention by providing movable shields which automatically engage the camshaft body between the hardened and unhardened lobes after the camshaft is properly indexed adjacent the inductor. During the heat treating cycle, the previously hardened cam lobes are sprayed with coolant to maintain the temperature below the tempering range notwithstanding stray induction heating or thermal transfer. The shields are effective for fluidly isolating the lobes and prevent coolant from impinging on the cam lobes undergoing heat treatment. Additionally, the shield permits a more even quenching of the heated lobe by retaining its quenching media closely adjacent thereto. This permits a low velocity, low volume spray providing a more uniform cooling rate and consequently more uniform hardness. After heat treating, the shields are automatically withdrawn and the camshaft is indexed to the next unhardened lobe.

Accordingly, it is an object of the present invention to provide a method and apparatus for heat treating camshafts which avoids tempering of previously hardened surfaces.

It is another object of the present invention to provide for uniform quenching of an inductively heated cam lobe.

It is a further object of the invention to provide an apparatus for efficiently heat treating camshafts using high intensity, short time inductive heating and for obtaining and maintaining uniformly hardened cam lobes and bearing surfaces.

Still another object of the invention is the provision of automatically actuated coolant shields which fluidly isolate a previously hardened camshaft surface to permit cooling thereof during the inductive heating of an adjacent surface to thereby avoid tempering of the hardened surface and coolant contact with the surface being heated.

BRIEF DESCRIPTION OF THE DRAWINGS

The above and other advantages and benefits of the invention will become apparent upon reading the following description taken in conjunction with the accompanying drawings, in which.

DETAILED DESCRIPTION OF PREFERRED EMBODIMENT

Figures 1, 2:
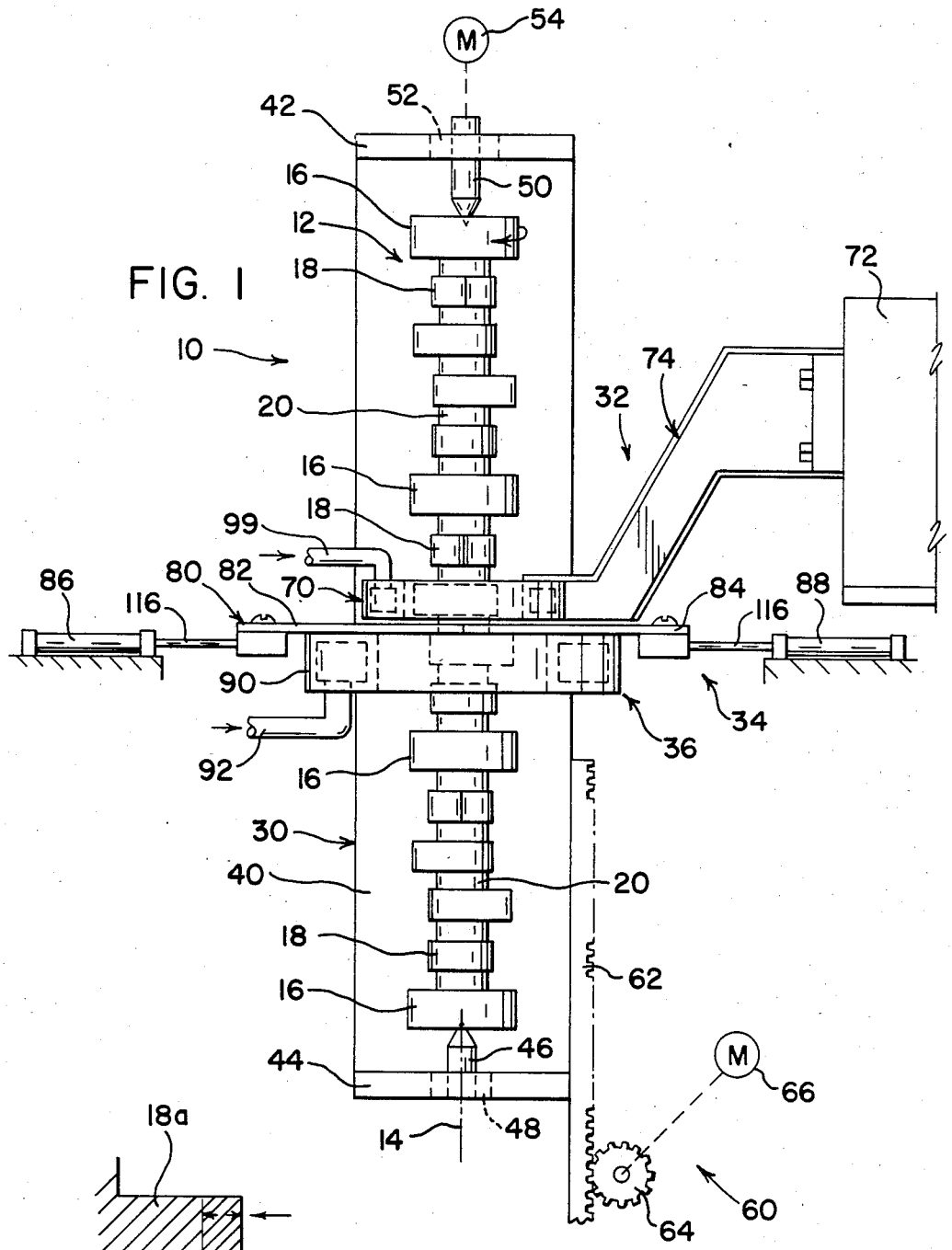
FIG. 1 is a vertical elevational view of a camshaft heat treating apparatus in accordance with the invention.
FIG. 2 is an enlarged partial cross-sectional view of a hardened camshaft lobe.

Referring to the drawings for purposes of illustrating the preferred embodiment and not for limiting same, FIG. 1 shows a camshaft heat treating apparatus 10 for heat treating a camshaft 12 of the type used in internal combustion engines. The camshaft 12 in a conventional manner comprises an elongate body rotatable about a longitudinal axis 14 and having four generally equally axially spaced cylindrical bearings 16 between which are axially spaced cam lobes 18. The bearings 16 and the cam lobes 18 are mutually spaced by cylindrical body portions 20. The bearings 16 are disposed coaxial with the axis 14. The cam lobes 18 are eccentrically disposed with respect to the axis 14 and are circumferentially oriented and peripherally profiled to impart, in assembly, a predetermined controlled reciprocation to associated valve followers to thereby control the flow of gases past associated intake and exhaust valves.

The apparatus 10 generally comprises a support frame 30, an induction heating assembly 32, a shielding unit 34 and a supplemental cooling assembly 36.

The support frame 30 includes a vertical rectangular base 40 and projecting flanges 42, 44 vertically spaced a distance greater than the length of the camshaft 12. The lower flange 44 rotatably supports a fixed datum center 46 in a bearing 48 coaxially with the axis 14. The upper flange 44 rotatably supports a live center 50 in a bearing 52 coaxially with the axis 14. The live center 50 is axially movable by suitable means, not shown, between the illustrated operative position engaging and centering the upper end of the camshaft 12 and an upper retracted position which permits loading and unloading of the camshaft from the support frame 30. The live center 50 is operatively connected to a control motor 54 for rotating a loaded camshaft about the axis 14 as described in greater detail below.

The support frame 30 is connected to a vertical rack and pinion drive 60. The drive 60 comprises a rack 62, a pinion 64 and a control motor 66. The rack 62 is vertically attached at the side of the base 40. The motor 66 is operatively connected to the pinion 64 and mounted on fixed support structure, not shown. The teeth of the pinion 64 drivingly engage the teeth of the rack 62. Selective energization of the motor 66, as described ingreater detail below, rotates the pinion 64 to vertically drive the rack 62 and the support frame 30 with respect thereto. The support frame 30 may be vertically slidably supported relative to the fixed structure by suitable conventional guide means, not shown. While shown vertically oriented, the unit 10 is also suitable for operation in other orientations including the horizontal.

The induction heating assembly 32 comprises a single turn. integral type quench inductor 70. The inductor is conventionally electrically connected to a high frequency power supply 72 by a lead assembly 74.

The shielding unit 34 comprises a split shield assembly 80 having plates 82 and 84 operatively connected to linear actuators 86 and 88, respectively. The actuators 86 and 88 are operative as described below to shift the plates 82 and 84 between the illustrated operative position and a retracted position, shown in dashed lines. The supplemental cooling assembly 36 comprises an annular cooling ring 90 and a coolant conduit 92. The ring 90 is axially spaced from the coil 70 by the shield 80 and supported by suitable support structure, not shown. Coolant from a coolant supply, not shown, is delivered through the conduit 92 to the ring 90.

Figure 3:
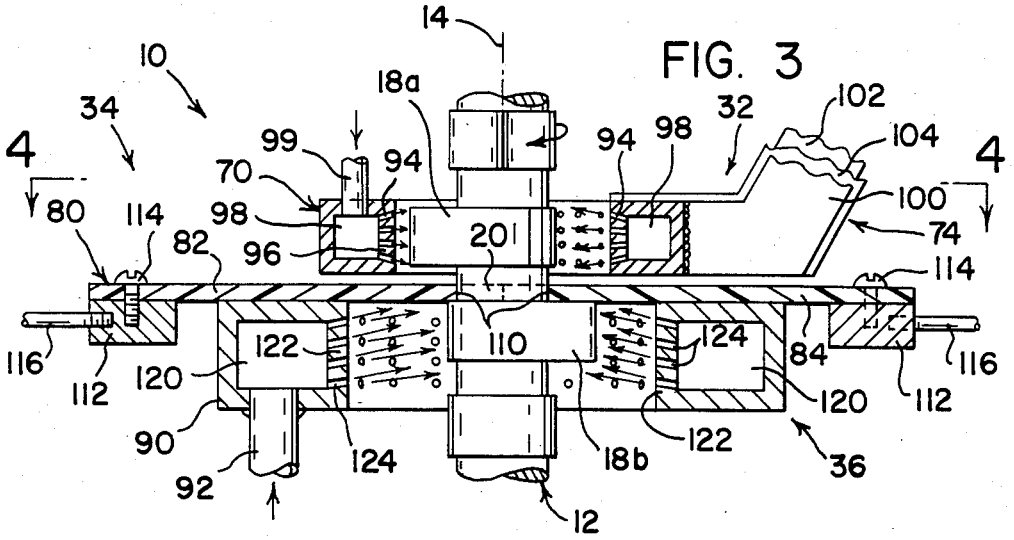
FIG. 3 is an enlarged cross-sectional view of the induction heating assembly, shielding unit and supplemental cooling assembly shown in FIG. 1.
Figure 4:
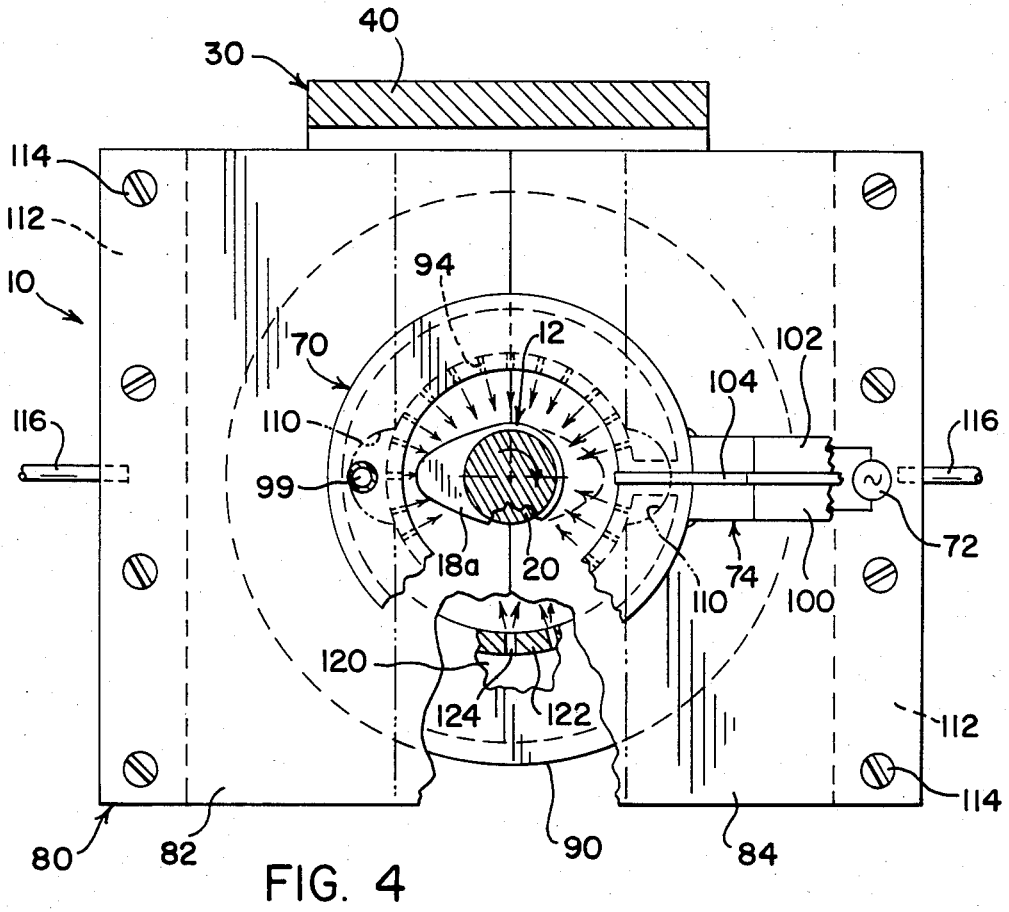
FIG. 4 is a view taken along line 4—4 in FIG. 3.

Referring additionally to FIGS. 3 and 4, the inductor 70 is a circular ring having a thin wall hollow rectangular cross-section. The inductor 70 is radially split at a narrow gap. The inner cylindrical surface of the inductor 70 has a diameter slightly larger than the bearings 16 and the cam lobes 18, but of a relationship that provides the desired inductive coupling therewith. A plurality of radially directed ports 94 are formed in the inner cylindrical wall 96 of the inductor 70 in fluid communication with the interior passage 98 thereof. Coolant supplied from the source through a conduit 99 flows into the passage 98 and outwardly through the ports 94 onto the heated cam lobe 18*a*. The ports 94 are aligned and sized to provide a uniform spray of low velocity fluid during the quenching cycle in a manner which avoids profile alteration.

The lead assembly 74 comprises a first lead 100 and a second lead 102 mutually separated by non-conductive spacer 104. The spacer 104 has an inner end received within the gap in the inductor 70. The inner end of the first lead 100 is connected to the outer wall of the inductor 70 adjacent the gap by brazing. The outer end of the first lead 100 is connected to one of the output terminals of the power supply 72. The inner end of the second lead 102 is connected to the outer wall of the inductor 70 on the other side of the gap by brazing. The outer end of the second lead 102 is connected to the other output terminal of the power supply 72. The power supply energizes the inductor 70 through the lead assembly 72 to inductively heat and raise the temperature of the cam lobe 18*a* to an elevated heat treating temperature. The heating cycle comprises a high frequency, high power short duration cycle of about 3 to 500 KHz, at least about 25 $KW/in^2$ and for 0.5 to 3.0 seconds.

After the inductive heating, the power supply 72 is deenergized and coolant is delivered from the source under the control of appropriate valving through the conduit 99 to the passage 98 and outwardly onto the outer surface of the cam lobe 18*a* to provide rapid quenching thereof. The cycle will produce a hardness to a substantial depth d as shown in FIG. 2.

The shield assembly 80 is symmetrically disposed with respect to a vertical plane through the axis 14. The inner lateral edges of the plates 82, 84 abut in the closed position. Each plate 82, 84 is provided with a semi-circular notch 110 at the inner lateral edges having a diameter substantially the same as the diameter of the camshaft body portions 20. The peripheral surface of the notches 110 thus conform to the body portion 20 in the closed position. The outer edges of the plates 82, 84 are secured to a reinforcing bar 112 by means of fasteners 114. The output shaft 116 of the actuators 86, 88 are connected to the bars 112. The stroke of the shafts 116 shifts the plates from the closed position shown in FIG. 3 to the open position shown by the dashed lines in FIG. 4. In the open position, axial indexing of the camshaft is accommodated. The plates 82, 84 may be formed of a suitable conductive or non-conductive material.

The supplemental cooling assembly 36 comprises the aforementioned cooling ring 90 which is a continuous ring of thin wall, rectangular hollow tubing having an interior passage 120 fluidly connected to the conduit 92. The ring 90 is substantially greater in diameter and cross-section than the inductor coil. The inner wall 122 of the ring 90 is provided with uniformly distributed radially directed ports 124 for directing coolant onto the surface of a previously heat treated cam lobe 18*b*. The supplemental cooling assembly 36 is adapted to deliver a high volume of coolant into the annular area defined by the cam lobe 18*b*, the lower surface of the plates 82, 84 and the inner surface of the ring 90. The coolant provides sufficient cooling to the previously hardened cam surface to prevent a temperature rise into the tempering range of the camshaft material. During such cooling, the plates 82 and 84 and the intermediate camshaft body portion 20 isolate the camshaft lobe 18*a* from the supplemental coolant to avoid any interference with the controlled heat quench cycle thereof. Preferably, the coolant for the inductor 70 and the ring 90 is delivered from a common source under the control of separate valving to achieve the aforementioned functions and sequenching as described below.

The aforementioned components are amenable to many obvious variations. For instance, while the indexing has been through translation of the camshafts relative to the apparatus, the unit itself may translate with respect to a fixedly located camshaft. Moreover, multiple heating and cooling assemblies may be provided for serially heat treating groups of the cam surfaces. Further, the camshaft may be disposed at various inclinations including horizontal. In such cases, it may be preferable to provide shield assemblies on either side of the cam surface being heated to retain the coolant on the cam surface in a flooding mode. Additionally, rather than rotating the camshaft during the induction heating, the inductor may be appropriately sized and the camshaft selectively rotated to circumferentially index and thereafter heat the indexed cam to thereby provide the desired case hardening of the surfaces.

OPERATION OF THE PREFERRED EMBOIDMENT

Figure 5A:
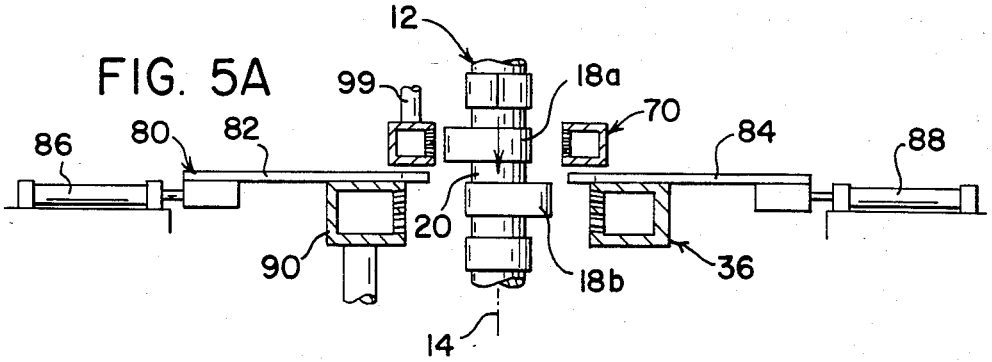
FIGS. 5*a* through 5*f* illustrate the operation of the camshaft heat treating apparatus during a heat treating cycle.
Figure 5B:
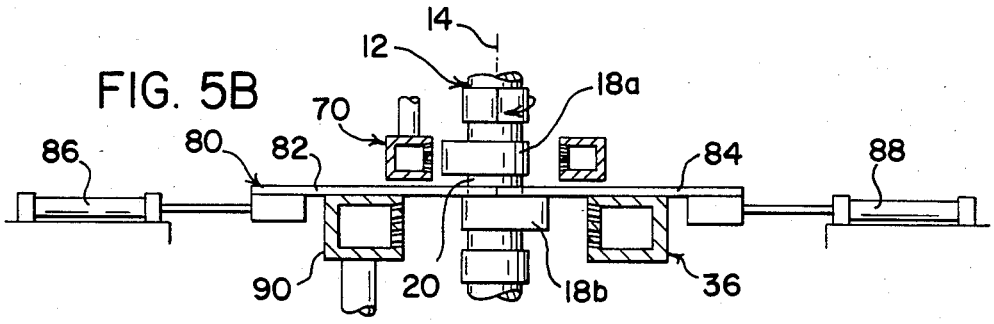
Figure 5C:
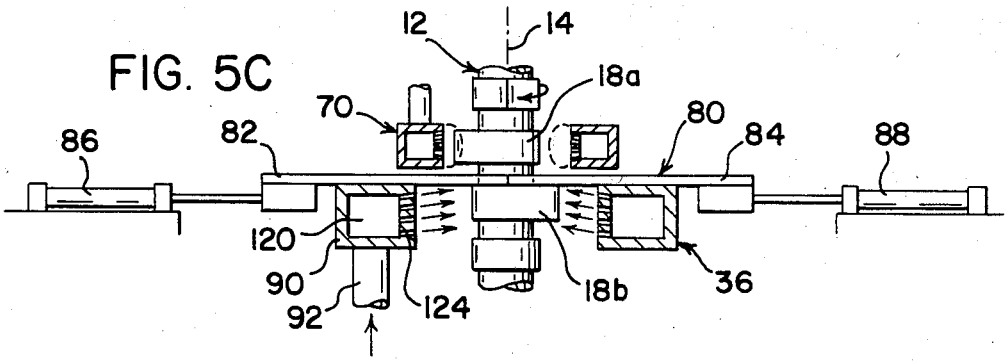

Referring additionally to FIGS. 5*a*–5*f*, a camshaft 12 after loading between the centers 50 and 46 of the support serially traverses the induction assembly to heat treat the various bearings 16 and cam lobes 18. The selective axial positioning is provided by the drive unit 60 whereby as shown in FIG. 1, the inductor 70 is positioned adjacent a cam lobe midway along the length of the camshaft 12. At this position, as shown in FIG. 5*a* the actuators 86, 88 are retracted and the shield plates 82, 84 of the shield assembly 80 are at the illustrated open position. This permits axial indexing of a previously heat treated cam lobe 18*b* below the plates 82, 84 and an untreated cam lobe 18*a* above the plates 82, 84 adjacent the inductor 70. The plates 82. 84 are aligned with the intermediate body portion 20. The coolant flow to the inductor and the ring 90 is valved off. Subsequently, as shown in FIG. 5*b*, the actuators 86, 88 are extended to shift the shield assembly 80 to the illustrated closed position, with the notches of the plates 82 and 84 closely surrounding the camshaft body portion 20 and fluidly and physically isolating the heat treated cam lobe 18*b* and the supplemental cooling assembly from the untreated cam lobe 18*a* and the inductor 70. At this time, the motor 54 is energized to rotate the camshaft 12 continuously or to an indexed position about the axis. After the indexing of the camshaft and closing of the shield assembly 80, the inductor 70, as shown in FIG. 5*c*, is energized to inductively heat the cam lobe 18*a*. Concurrently, coolant is delivered through conduit 92 to the cooling ring 90 into annular passage 120 and outwardly through the port 124 onto the heat treated cam lobe 18*b*. The shield assembly 80 confines the coolant therebelow effectively maintaining the temperature of the cam lobe 18*b* below the tempering temperature notwithstanding stray inductive heating or thermal conduction and also preventing coolant flow to cam lobe 18*a*. Thus, the cam lobe 18*a* is uniformly inductively heated and the heat treated integrity of the cam lobe 18*b* maintained.

Figure 5D:
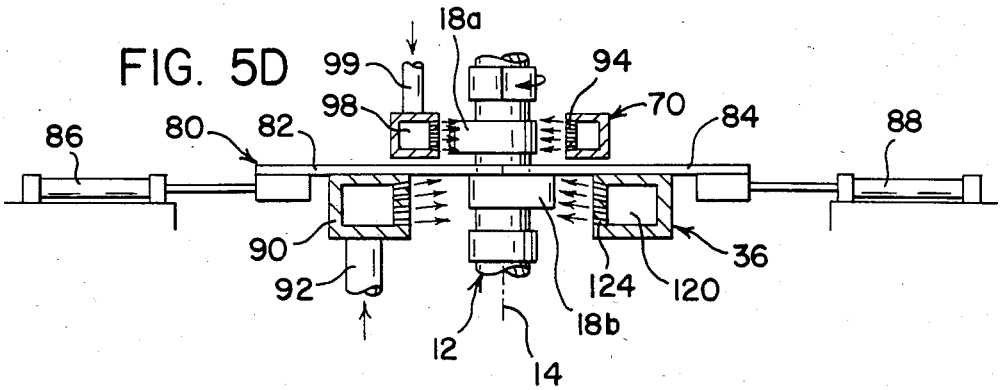

Following the inductive heating. as shown in FIG. 5*d*. the inductor 70 is deenergized and coolant is delivered through conduit 99 to the annular passage 98 and outwardly through the ports 94 onto the heated surface of the cam lobe 18*a*. Coolant continues to flow onto cam lobe 18*b* from the cooling ring 90. In this mode, the shield assembly 80 is effective to retain coolant at the cam interface to provide a flooding action insuring a uniform quenching cycle to provide the desired hardening as shown in FIG. 2.

Figure 5E:
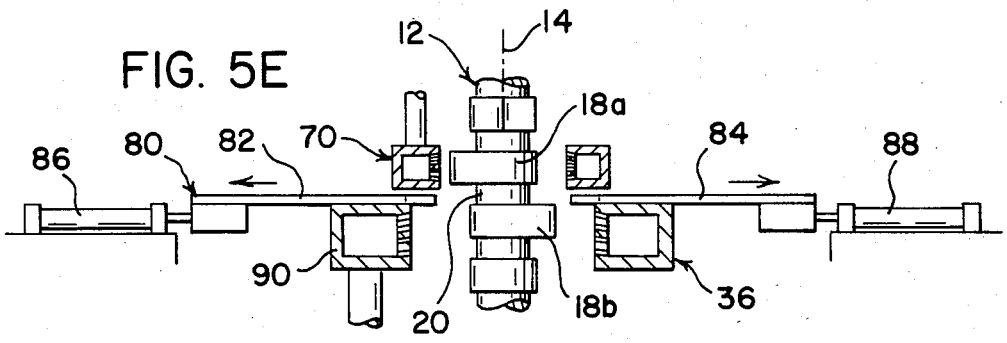
Figure 5F:
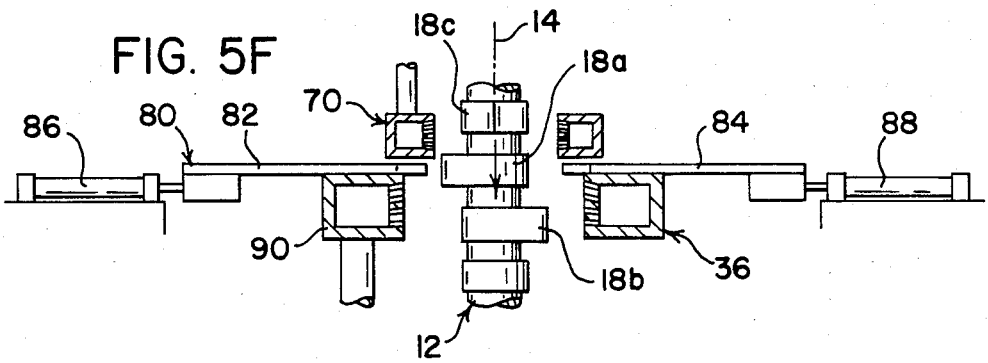

Subsequent to quenching, as shown in FIG. 5*e*, the flow of coolant to the inductor 70 and the cooling ring 90 is terminated, the motor 54 is deenergized to stop camshaft rotation, and the actuators 86, 88 retracted to move the shield assembly 80 to the open position. Thereafter, the next hardening cycle is initiated by energizing motor 66 to thereby shift the support frame 30 and the camshaft 12 downwardly, as shown in FIG. 5*f*, with cam lobe 18*a* being located adjacent the cooling ring 90 and an untreated cam lobe 18*c* being located in the heating position adjacent the inductor 70. Should a bearing occupy the adjacent position, the aforementioned cycle remains the same. However, the heating and quenching may be altered to the extent necessary if different hardness parameters are prescribed therefor.

The operation has been described with reference to the sequencing of the functions of the preferred embodiment. Obviously, the requirements of a particular design will alter the parameter to be therein employed. Thus, the inductive heating and quenching cycles will be appropriately selected for each design. Further, a particular design may vary requirements for the cam lobes and bearing surface which may be accommodated by selective control of the heating and quenching systems. Moreover. continuous operation of the supplemental cooling system may not be required during the heating and quenching cycles to prevent tempering of the hardened surfaces. Also, in certain cases, the supplemental cooling ring can be used as the primary quench for the heat cam lobe. This will increase production capacity. As one cam is being heated, the previously heated cam is being quenched by the cooling ring. Thus, the various positioning and control functions have been, in part, schematically referenced with the details of construction therefor and for other obvious alteration and various being readily apparent to those skilled in the art.

We claim:

1. An apparatus for heat treating a plurality of unhardened cam lobes on a camshaft, comprising:

support means for supporting the camshaft for rotation about a longitudinal axis;

means for selectively rotating said camshaft about said axis;

inductor means adapted to encircle the cam lobes in inductive heating relationship therewith;

drive means for locating said inductor means sequentially at the unhardened cam lobes;

shield means movable to an operative position closely encircling the camshaft between successive cam lobes including the cam lobes then located at said inductor means;

means for energizing said inductor means when said shield means is in said operative position to inductively heat the unhardened cam lobe to a predetermined heat treating temperature;

first cooling means operative subsequent to said energizing for delivering liquid media on the cam lobe at said heat treating temperature and cool such cam lobe at a controlled rate to provide a predetermined surface hardness;

second cooling means for delivering liquid media on the hardened cam lobe adjacent said shield means after said shield means is in said operative position concurrent with said inductor means and said first cooling means, said second cooling means providing sufficient cooling of said hardened cam lobe to prevent tempering thereof.

2. An apparatus for heat treating the cam lobes of a camshaft, said cam lobes being axially separated by cylindrical body sections, comprising:

support means for rotatably supporting the camshaft for rotation about a longitudinal axis;

means for selectively rotating said camshaft about said axis;

a circular inductor coil adapted to encircle the cam lobes in coaxial and inductive heating relationship therewith;

drive means for sequentially locating said inductor coil at each of said cam lobes;

shield means movable between a transfer position spaced from the camshaft and an operative position closely encircling the body sections between a first cam lobe located at said inductor coil and a second cam lobe previously heated at said inductor coil;

power supply means for energizing said inductor coil when said shield means is in said operative position; and, a first cooling device for delivering liquid media on said second cam lobe when said shield means is in said operative position and said inductor coil is energized, said liquid media providing sufficient cooling of said cam lobe to prevent tempering thereof.

3. The apparatus as recited in claim 2 wherein said means for selectively rotating is operative during the energizing of said inductor coil.

4. The apparatus as recited in claim 2 wherein a second cooling device delivers liquid media onto said first cam lobe for the cooling thereof at a controlled rate when said shield means is in said operative position and subsequent to the energizing of said inductor coil.

5. The apparatus as recited in claim 2 wherein said first cooling device is operative during energizing of said inductor coil and said cooling of said first cam lobe by said second cooling device.

6. The apparatus as recited in claim 2 wherein said shield means includes a first and second member having semi-circular recessed surfaces closely engageable with the body section of the camshaft in said operative position.

7. The apparatus as recited in claim 6 including actuator means for moving said first and second members between said retracted position and said operative position.

8. The apparatus as recited in claim 7 wherein said inductor coil, said shield means and said first and second cooling devices are fixedly supported by said support means, and said indexing means is slidably operatively connected to said support means for axially advancing said camshaft past said inductor coil.

9. The apparatus as recited in claim 2 wherein said means for selectively rotating is operative to circumferentially index the camshaft with respect to said inductor.

10. The apparatus as recited in claim 2 including indexing means operative in said retracted position of said shield means for advancing said camshaft relative to said inductor coil and positioning said first cam lobe adjacent said first cooling device and third cam lobe adjacent said inductor coil.

11. A method of inductively heat treating a camshaft having an elongated cylindrical body including a plurality of closely axially spaced unhardened surfaces mutually separated by cylindrical body portions comprising the steps of:

(a) providing inductor means for inductively heating discrete unhardened surfaces to a predetermined elevated heat treating temperature;

(b) indexing said inductor means with respect to said camshaft with sequential heat treating positions adjacent a discrete unhardened surface and in inductively coupled relationship thereto;

(c) energizing said inductor means during a heating cycle at said heating position to inductively heat said discrete unhardened surface to a predetermined temperature;

(d) providing a first quenching device with respect to said inductor means at the previously inductively heated surface adjacent said heating position for delivering coolant onto said previously inductively heated surface;

(e) prior to said energizing of step (c), physically and fluidly isolating the surface at said heating position from the adjacent previously heated surface by interposing a shield therebetween in close conformity with the body portion of the camshaft therebetween;

(f) during said energizing of step (c), delivering coolant to said first quenching device under conditions effective for maintaining the temperature of said previously inductively heated surface below the tempering temperature thereof; and, (g) spacing said shield from said body portion and reindexing said first quenching device and said inductor means with respect to said camshaft to present an unhardened surface adjacent said inductor means and a previously inductively heated surface adjacent said first quenching device.

12. The method of claim 11 including repeating steps (a) through (g) until all of said surfaces have been hardened.

13. The method as recited in claim uding the step (h) of providing a second quenching device at said heating position for delivering coolant onto the inductively heated surface thereat.

14. The method as recited in claim 13 including the step (i) of subsequent to the energizing of step (c), delivering coolant to said second quenching device under conditions effective for cooling said inductively heated surface from said heat treating temperature at a rate effective for establishing a predetermined harness therefor.

15. The method of claim 11, including maintaining delivery of coolant to aid first quenching device during the cooling of step (g).

16. The method of claim 11 including rotating the camshaft during step (c).

17. The method of claim 16 including rotating the camshaft during step (g).

18. The method of claim 11 including rotating the camshaft to a predetermined circumferential position with respect to said inductor means prior to the energizing thereof.

19. The method of claim 11 including physically and fluidly isolating with a shield of a non-magnetic material.

20. The method of claim 11 wherein said inductor means and said quenching device are stationary and said indexing of step (b) is sequential axial movement of the camshaft.

21. An apparatus for hardening a plurality of axially spaced cams on an elongated camshaft, said apparatus comprising: means for selectively rotating said camshaft about a generally vertical axis; an induction heating coil having an inner wall surrounding said axis, a gap in said inner wall and quench liquid openings in said inner wall and directed toward said axis; a supplemental cooling assembly below said induction heating coil and having cooling liquid openings directed toward said axis; means for indexing said camshaft axially to a position with one cam within said induction heating coil and an adjacent one of said cam within said cooling assembly; means for energizing said induction heating coil with a relatively high power for a heating cycle of 0.5 to 3.0 seconds; means for forcing quenching liquid through said quench liquid openings in said inner wall after said heating cycle; means for forcing liquid through said cooling liquid openings during said heating cycle; means for preventing said cooling fluid from impinging upon said one cam as it is being inductively heated by said induction heating coil during said heating cycle; and, means for indexing said camshaft axially downwardly with respect to said coil and cooling assembly until said one cam is within said cooling assembly and a third unhardened cam is in said induction heating coil.

22. An apparatus as defined in claim 21 wherein said preventing means includes shield means moveable to a operative position closely encircling said cam shaft between said induction heating coil and said supplemental cooling assembly at least during said heating cycle.

23. An apparatus as defined in claim 22 wherein said energizing means is a high frequency power supply and said high power is about 25 $KW/in^2$.

24. An apparatus as defined in claim 21 wherein said selective rotating means includes means for circumferentially indexing said one cam to an indexed position about said axis preparatory to induction heating.

25. A method of hardening a plurality of axially spaced cams on an elongated camshaft with a central axis, said method comprising the steps of:

(a) providing an upper induction heating coil and a vertically aligned, lower cooling assembly with a vertical passageway through said coil and said cooling assembly;

(b) mounting said camshaft vertically with said axis extending through said vertical passageway;

(c) indexing said camshaft axially with respect to said coil and cooling assembly until one cam is within said coil;

(d) indexing said camshaft circumferentially into a desired indexed position;

(e) energizing said coil with a high power and for a heating cycle of 0.5 to 2.0 seconds;

(f) forcing a quenching liquid through said coil onto said heated one cam;

(g) then indexing said camshaft vertically downwardly with respect to said passageway unit said one cam is within said cooling assembly and another cam above said one cam is in said induction heating coil;

(h) repeating said heating cycle while cooling said one cam with liquid from said cooling assembly and (i) preventing cooling liquid from interfering with said heating of said another cam in said induction heating coil.

26. A method as refined in 25 wherein said preventing step includes the step of:

(j) moving shields between said coil and said cooling assembly during said heating cycle.

* * * * *